United States Patent [19]

Fujimoto et al.

[11] 4,208,139

[45] Jun. 17, 1980

[54] CARRIAGE POSITION CONTROL IN A PRINTER OF THE CARRIAGE TRAVELING MODE

[75] Inventors: Isao Fujimoto, Kunitachi; Takeshi Kasubuchi; Yuji Sumitomo, both of Nara, all of Japan

[73] Assignee: Sharp Kabushiki Kaisha, Osaka, Japan

[21] Appl. No.: 870,486

[22] Filed: Jan. 18, 1978

Related U.S. Application Data

[63] Continuation of Ser. No. 610,752, Sep. 5, 1975, abandoned.

[30] Foreign Application Priority Data

Sep. 6, 1974 [JP] Japan ..... 49-103310

[51] Int. Cl.[2] ..... B41J 3/04; B41J 19/30; B41J 19/50

[52] U.S. Cl. ..... 400/126; 400/322; 101/93.15; 346/75; 318/685

[58] Field of Search ..... 400/126, 322, 320, 144.2, 400/162.3, 134.2; 346/75; 318/685; 101/93.14, 93.15,

[56] References Cited

U.S. PATENT DOCUMENTS

| | | | |
|---|---|---|---|
| 3,353,483 | 11/1967 | Foley | 101/93.14 |
| 3,443,181 | 5/1969 | Kozol et al. | 318/685 |
| 3,586,953 | 6/1971 | Markkanen et al. | 318/685 |
| 3,715,021 | 2/1973 | Caspari | 400/322 |
| 3,772,514 | 11/1973 | Sunderland | 250/551 |
| 3,789,971 | 2/1974 | Deyesso et al. | 400/154.3 |
| 3,822,097 | 7/1974 | Allington | 250/578 X |
| 3,831,728 | 8/1974 | Woods et al. | 346/75 |
| 3,834,505 | 9/1974 | Fowler et al. | 400/126 |
| 3,837,457 | 9/1974 | Anglin et al. | 400/162.3 |
| 3,845,378 | 10/1974 | Hendrickson et al. | 318/685 |
| 3,925,787 | 12/1975 | Suzuki | 400/126 |

*Primary Examiner*—William Pieprz
*Attorney, Agent, or Firm*—Birch, Stewart, Kolasch & Birch

[57] ABSTRACT

A detection means is provided for generating an analog signal in response to a rotation angle of a servomotor which drives a carriage in a printer. A servomotor drive circuit is responsive to a print command from an input means and the analog signal from the detection means, whereby the carriage is driven to travel forward upon receipt of the print command and to stop upon receipt of a print termination signal. The carriage is then held stationary at a predetermined position suitable for the next character to be printed as determined by the rotation angle of the servomotor which is fed back to the servomotor drive circuit.

7 Claims, 6 Drawing Figures

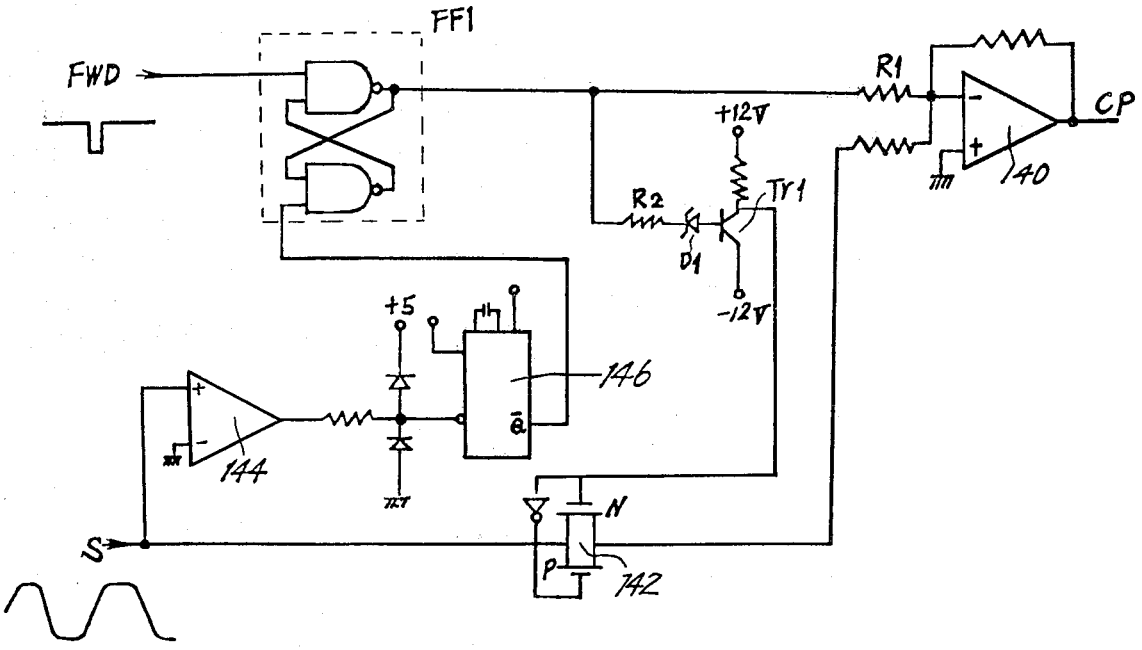
FIG. 4 (SERVOMOTOR DRIVE CIRCUIT -14-)
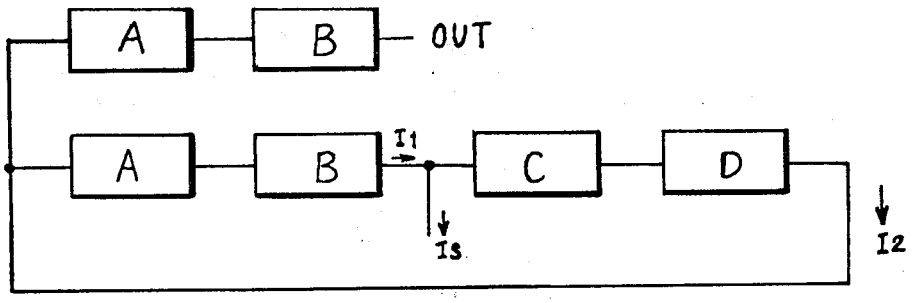
FIG. 6

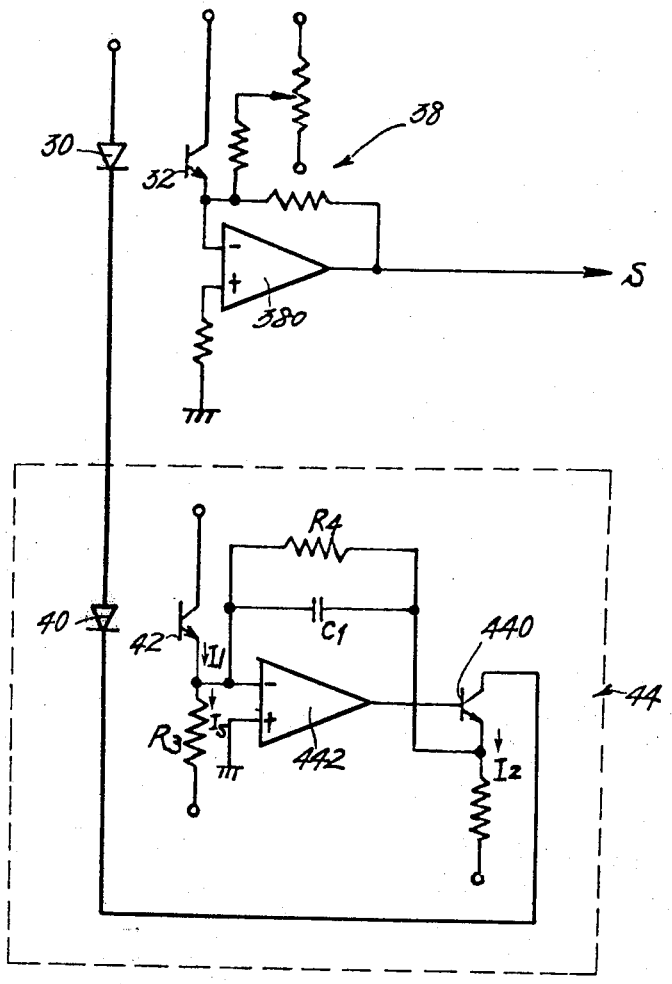
FIG. 5 (TEMPERATURE COMPENSATION CIRCUIT -44-)

CARRIAGE POSITION CONTROL IN A PRINTER OF THE CARRIAGE TRAVELING MODE

This application is a continuation, of copending application Ser. No. 610,752, filed on Sept. 5, 1975 and now abandoned.

BACKGROUND OF THE INVENTION

The present invention relates to a printer which has a traveling print head.

The present invention relates more particularly to a carriage position control system in a printer having a traveling print head or a carriage such as an ink jet system printer or a thermal printer.

The present invention will be described in conjunction with an ink jet system printer.

In general, in an ink jet system printer, a carriage is driven to travel in a reciprocating mode with respect to a recording paper to perform a desired printing. When the ink jet system printer is used as an input device or an intermittent mode printer, the carriage must intermittently travel in response to an input signal from a suitable input unit such as a keyboard. The intermittent travel is achieved by provision of a servomotor for driving the carriage to travel at a predetermined length of distance in response to the input signal. In this intermittent mode, the carriage must be held stationary at a predetermined position and driven to travel at a predetermined length of distance in response to the input signal and thereafter held stationary at a next predetermined position.

The position of the carriage can be detected with the use of a disc having slits mounted on the shaft of the servomotor. When the carriage is controlled to stop at a predetermined position with the use of an optical system including the slit disc, the standstill position may unavoidably vary. This variation is caused by the variation of characteristics of electronic elements used in the optical system dependent upon the temperature or caused by the variation of the rotation angle of the servomotor till a print termination signal is generated.

The variation of the standstill position of the carriage may preclude a clean printing.

OBJECTS AND SUMMARY OF THE INVENTION

Accordingly, an object of the present invention is to stabilize the printing position in a printer having a traveling print head.

Another object of the present invention is to provide a carriage position control circuit in a printer having a carriage on which a print head is mounted.

Still another object of the present invention is to provide a servomotor control circuit in a printer wherein a print head is driven to travel by a servomotor.

Yet another object of the present invention is to provide a detection means suitable for detecting a rotation angle of a servomotor which drives a carriage in a printer.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to one embodiment of the present invention, a detection means comprising a slit disc is mounted on a shaft of the servomotor in order to generate an analog signal in response to a rotation angle of a servomotor which drives a carriage in a printer. The servomotor is driven to travel forward upon receipt of a print command from an input means and to stop upon receiving a print termination signal from said detection means.

The carriage is held stationary at a predetermined position with the use of the anologue signal from the detection means. When the detection means comprises a light-emitting element and a light-receiving element, it is preferable to provide a compensation means to compensate the variation of the voltage level of the analog signal, such variation being mainly caused by the variation of the characteristics of the light-emitting element.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

FIG. 4 is a circuit diagram of the servomotor drive circuit of FIG. 1;

FIG. 5 is a circuit diagram of the temperature compensation circuit of FIG. 1; and FIG. 6 is a block diagram for the purpose of explanation of an operation mode of the temperature compensation circuit of FIG. 5.

DESCRIPTION OF THE PREFERRED EMBODIMENTS

Figure 1:
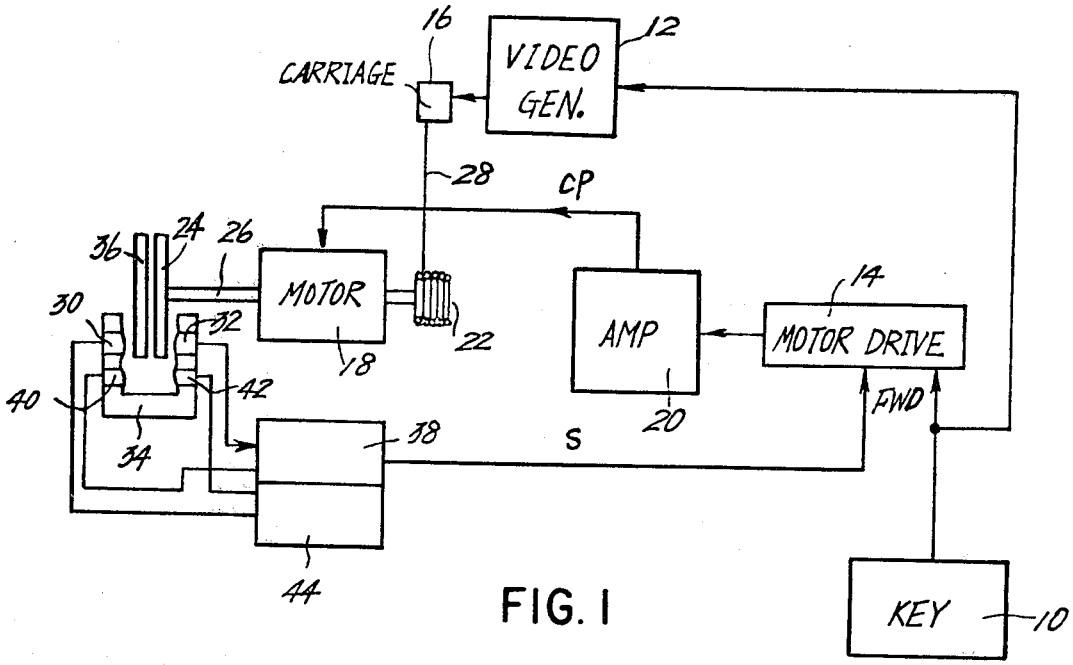
FIG. 1 is a schematic block diagram of a carriage drive system in a printer of the present invention including a servomotor drive circuit, a rotatable slit disc, and a temperature compensation circuit.

Referring now to FIG. 1, there is illustrated a schematic construction of a carriage drive system of the present invention, a key input signal from a keyboard 10 is introduced into a video generator 12 and a servomotor drive circuit 14 as an intermittent forward signal FWD upon depression any one of keys provided on the keyboard 10. The video generator 10 can be of a conventional construction and provides a print information signal in a suitable format to a carriage 16 in response to a key input signal.

The servomotor drive circuit 14 drives a servomotor 18 to rotate via an amplifier 20 upon receiving the intermittent forward signal FWD from the keyboard 10. When a carriage drive signal CP from the amplifier 20 bears a positive voltage level, the servomotor 18 rotates in a direction to force the carriage 16 to travel forward, whereas the servomotor 18 rotates in a direction to force the carriage 16 to travel backward when the carriage drive signal CP bears a negative voltage level.

A pulley 22 and a slit disc 24 are mounted on a shaft 26 of the servomotor 18 in a fashion to rotate in unison with the revolution of the servomotor 18. The pulley 22 is communicated with the carriage 16 through a wire 28 in order to drive the carriage 16 in response to the revolution of the servomotor 18.

Figure 2:
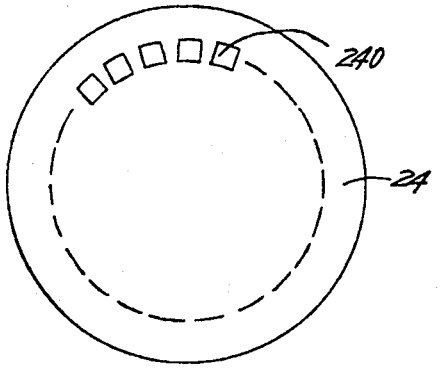
FIG. 2 is a plan view of the rotatable slit disc of FIG. 1.

The slit disc 24 has quadrangular slits 240 circularly aligned with a predetermined spacing as shown in FIG. 2. A light-emitting diode 30 and a light-receiving element 32 are mounted on a holder 34 made of resin in a fashion that the optical axis from the light-emitting diode 30 to the light-receiving element 32 passes through the quadrangular slits 240 provided on the slit disc 24. A fixed slit plate 36 has a same size as that of the slit disc 24 and has quadrangular slits of the same shape as that of the slits on the slit disc 24 at a position corresponding to the quadrangular slits 240 on the slit disc 24.

Figure 3:
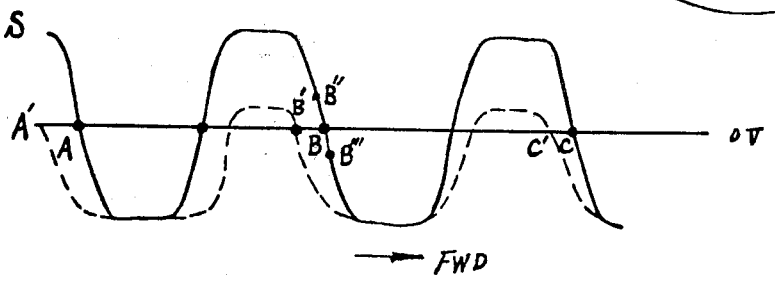
FIG. 3 is a waveform of an anologue signal generated with the use of a signal associated with the rotatable slit disc of FIG. 1.

The above-mentioned optical system provides a position indication signal S as shown in FIG. 3 in response to the revolution of the slit disc 24 mounted on the shaft 26 of the servomotor 18. The position indication signal S, which indicates the rotation angle of the servomotor 18 or the location of the carriage 16, is fed back to the servomotor drive circuit 14 via the output of an amplifier 38.

The position indication signal S has a positive voltage potential when the optical axis of said optical system passes through the quadrangular slits 240 provided on the slit disc 24, whereas the signal S bears a negative voltage level when the optical axis passes through the slit disc 24 outside of the quadrangular slits 240. In FIG. 3, points A, B and C represent the points at which the carriage 16 must be held stationary in an intermittent printing mode. The points A, B and C correspond to the points where the quadrangular slits on the slit disc 24 and the fixed slit plate 36 overlap with each other by a half size of the respective quadrangular slits.

The detailed construction and the operation mode of the carriage drive system of the present invention will be described with reference to FIGS. 4 through 6.

SERVOMOTOR DRIVE CIRCUIT 14 (FIG. 4)

Now assume that the carriage 16 is held stationary at a position corresponding to the point A. When the key on the keyboard 10 is depressed, the intermittent forward signal FWD is introduced into a flip-flop $FF_1$ to invert the flip-flop $FF_1$, which comprises two NAND gates. An output signal of the flip-flop $FF_1$ is introduced into an input terminal of a differential amplifier 140 via a resistor $R_1$, and into a transistor $Tr_1$ via a resistor $R_2$ and a Zener diode $D_1$. The inverted output, for example, 5 V from the flip-flop $FF_1$ turns ON the transistor $Tr_1$ and hence turns OFF an anologue switch 142. The analogue switch 142 controls the introduction of the position indication signal S into the differential amplifier 140 in a fashion to preclude the introduction thereof when the analogue switch 142 is OFF. The differential amplifier 140 receives a signal of a certain positive level, for example, 5 V and generates the carriage drive signal CP to drive the carriage 16 forward.

When the carriage 16 reaches a point corresponding to the point B in FIG. 3, the position indication signal S bears a zero voltage level and, therefore, a differential amplifier 144 operates to trigger a one-shot multivibrator 146 to generate a print termination signal and invert the flip-flop $FF_1$. Upon this inversion the carriage drive signal CP bears a zero voltage level and the anologue switch 142 becomes ON. At this time the position indication signal S (approximate 0 V) is introduced into the differential amplifier 140 and, therefore, the carriage 16 is held stationary at the position exactly corresponding to the point B in FIG. 3.

When the carriage 16 is stopped at a point corresponding to a point B''' in FIG. 3, that is, the carriage 16 passes over a desired position corresponding to the point B, the position indication signal S from the optical system bears a negative voltage level. Therefore, the servomotor 18 is driven to rotate backward through the differential amplifier 140 and the carriage 16 reaches the desired position corresponding to the point B.

When the carriage 16 is stopped at a position corresponding to a point B'' in FIG. 3, that is, the carriage 16 is stopped before it reaches a desired position, the position indication signal S from the optical system is of a positive voltage level and, therefore, the servomotor 18 is driven to rotate forward through the differential amplifier 140. In this way the carriage 16 is held stationary at the preselected position corresponding to the point B in FIG. 3.

In the foregoing embodiment the print termination signal is generated at a time when the position indication signal S bears a zero voltage level and, therefore, the carriage 16 tends to pass over the desired position. It will be effective to provide an additional detection system in the video generator 12 for generating the print termination signal to reset the flip-flop $FF_1$.

The efficiency of the light-emitting diode 30 and the light-receiving element 32 may vary depending upon an ambient condition, for example, the ambient temperature of the printer. When the efficiency deteriorates, the position indication signal S becomes a signal of which a waveform is shown by dotted lines in FIG. 3. The carriage 16 may be driven to stop at positions corresponding to points A', B' and C' in FIG. 3. This will cause a variation of the printing position. To eliminate the above-mentioned variation, an additional of light-emitting diode 40 and light-receiving element 42 is mounted on the holder 34 for the temperature compensation. The light-emitting diode 40 and the light-receiving element 42 are provided at a position where the optical axis thereof is disturbed by neither the slit disc 24 nor the fixed slit plate 36. That is, the light beam emitted from the light-emitting diode 40 is always received by the light-receiving element 42.

TEMPERATURE COMPENSATION CIRCUIT 44 (FIG. 5)

An output current flow of the light-receiving element 32 is amplified by a differential amplifier 380 to provide the position indication signal S. The light-emitting diode 40, which is provided for the purpose of the temperature compensation, is connected with the light-emitting diode 30 and a current controlling transistor 440 in a series fashion. The light-receiving element 42, which is provided for the purpose of the temperature compensation, is connected with a resistor $R_3$ in a series fashion and an output signal thereof is introduced into one input terminal of a differential amplifier 442. An output signal of the differential amplifier 442 is conducted to the base electrode of the current controlling transistor 440, thereby controlling the current controlling transistor 440 in accordance with the output signal of the light-receiving element 42.

The temperature compensation circuit 44 functions to equalize an output current $I_1$ of the light-receiving element 42 with a preselected reference current $I_s$. The differential amplifier 442 detects the variation of the output current $I_1$ of the light-receiving element 42 and the output signal of the differential amplifier 442 controls the current controlling transistor 440 to control the current flow through the light-emitting diodes 30 and 40. The input terminal (negative side) of the differential amplifier 442 is connected with the emitter of the current controlling transistor 440 via a parallel connection comprising a resistor $R_4$ and a capacitor $C_1$ to enhance the stability of the temperature compensation circuit 44.

When the efficiency of the light-emitting diodes 30 and 40 and the light-receiving elements 32 and 42 deteriorates, the output current $I_1$ of the light-receiving element 42 decreases. The current reduction renders the output voltage level of the differential amplifier 442 high and, therefore, the current flow through the current controlling transistor 440 increases. This results in that the current flow through the light-emitting diode 40 increases and hence the light intensity emitted from the light-emitting diode 40 increases. Therefore, the output current $I_1$ of the light-receiving element 42 increases to reach the reference current $I_s$. The compensation circuit becomes stable when the output current $I_1$ of the light-receiving element 42 is identical with the reference current $I_s$.

The variation of the holding position of the carriage 16 caused by the temperature variation can be compensated when the light-emitting diode 30 and the light-receiving element 32 for generating the position indication signal S are made of the elements of the same characteristics as the light-emitting diode 40 and the light-receiving element 42.

The theoretical operation mode of the temperature compensation circuit 44 will be appreciated by the following description when considered in conjunction with FIG. 6.

The output current $I_1$ of the light-receiving element 42 can be expressed as follows:

$$I_1=(I_1-I_s)\text{C}\cdot\text{D}\cdot\text{A}\cdot\text{B} \quad (1)$$

Where A, B, C and D are transfer functions expressed as follows:

$$A: \frac{\text{brightness } F1 \text{ of light-emitting diode}}{\text{current flow } I_2 \text{ through light-emitting diode}}$$

$$B: \frac{\text{output current } I_1 \text{ of light-receiving element 42}}{\text{brightness } F1 \text{ of light-emitting diode}}$$

$$C: \frac{\text{output voltage level of differential amplifier 442}}{\text{output current } I_1 \text{ of light-receiving element 42}}$$

$$D: \frac{\text{current flow } I_2 \text{ through light-emitting diode}}{\text{output voltage level of differential amplifier 442}}$$

The equation (1) can be expressed as follows:

$$I_1 = \frac{1}{1-\frac{1}{CDAB}} I_s \quad (2)$$

It will be clear from equation (2) that the output current $I_1$ of the light-receiving element 42 is identical with the reference current $I_s$ without regard to the temperature variation when the gain of C and D is selected considerably high with respect to the variation of A and B depending upon the temperature variation.

The invention being thus described, it will be obvious that the same way be varied in many ways. Such variations are not to be regarded as a departure from the spirit and scope of the invention, and all such modifications are intended to be included within the scope of the following claims.

What is claimed is:

1. In an ink jet system printer which performs an intermittent printing operation by selectively driving a carriage carrying a printing head thereon from a first known position to a second desired position by means of a servomotor in driving relationship thereto in response to a print command input signal generated by the actuation of a key on said key input unit, said key introducing a print character, the improvement comprising:

driving and printing means responsive to the actuation of said key and to the occurrence of a said print command input signal from said key input unit for generating a servomotor drive signal of a fixed level to drive said servomotor and said carriage from said first known position solely in a forward direction to a new position approximating said second desired position and for printing said print character while said driving means is driving said carriage from said first known position to said new position;

detection means responsive to movement of said carriage for generating an analog signal of a first value representive of the location of said carriage in said new position;

said analog signal terminating said printing operation, nullifying said servomotor drive signal thereby terminating the drive of said carriage and holding said carriage stationary in said second desired position pending the actuation of a subsequent key and the occurrence of a subsequent input signal;

correction means responsive to the completion of each printing operation associated with a given print command input signal and a preselected second value of said analog signal corresponding to said second desired position for precluding the generation of a subsequent fixed level servomotor drive signal and generating a correction signal in response to a deviation of said first value of said analog signal from said preselected second value to cause said servomotor to reposition said carriage to accurately achieve and hold said carriage stationary in said second desired position pending the introduction of a subsequent print character entered via another key on said key input unit to subsequently generate said subsequent input signal thereby driving said carriage from said second desired position solely in a forward direction to another new position approximating a third desired position and printing said subsequent print character while said driving means is driving said carriage from said second desired position to said another new position.

2. The printer of claim 1 wherein the detection means comprises:

a slit disc mounted on a shaft of the servomotor;

a fixed slit plate associated with said slit disc;

slits circularly aligned on the slit disc and the fixed slit plate at positions corresponding with each other;

said slits being circularly aligned on the slit disc at positions corresponding to the width of said print character;

a light-emitting element;

a light-receiving element adapted to receive the light emitted from the light-emitting element and the passing through any one of said slits; and an amplifier for generating the analogue signal in response to an output signal from said light-receiving element.

3. The printer of claim 2 wherein said slits on said slit disc are rotatably driven by said shaft of said servomotor in response to actuation of one of said keys on said key input unit, one of said slits on said slit disc interrupting an optical axis between said light emitting element and said light-receiving element thereby generating a positive analog signal when said one of said slits on said slit disc is aligning itself with one of said slits on said fixed slit plate;

said servomotor driving said carriage in synchronism with the generation of said print command input signal thereby printing said print character on a print-receiving medium disposed on said carriage when said one of said slits on said slit disc is aligning itself with said one of said slits on said fixed slit plate;

said analog signal terminating said print operation, terminating the drive of said carriage and holding said carriage stationary when said one of said slits on said slit disc is driven to a non-alignment position relative to said one of said slits on said fixed slit plate;

said carriage being held stationary in said corresponding non-alignment position and said printing operation terminated pending actuation of another of said keys on said key input unit whereupon another of said slits on said slit disc interrupt said optical axis, aligning itself with said one of said slits on said fixed slit plate thereby driving said carriage in synchronism with the printing of said subsequent print character on said print-receiving medium disposed on said carriage; and said carriage being held stationary in each subsequent corresponding non-alignment position after termination of each subsequent printing operation pending actuation of another key on said key input unit.

4. The printer of claim 2, wherein the slits are quadrangular shaped.

5. The printer of claim 2, wherein the light-emitting element is a light-emitting diode.

6. The printer of claim 5, wherein said detection means further comprises:

a compensation means for compensating variations in the efficiency of the light-emitting diode and the light-receiving element in the detection means.

7. The printer of claim 6, wherein compensation means further comprises:

a compensation light-emitting diode and a compensation light-receiving element provided at positions where the optical axis thereof is not disturbed by either the slit disc or the fixed slit plate, the compensation light-emitting diode being connected with the light-emitting diode in the detection means in a series fashion; and a control means for controlling an output current from the compensation light-receiving element to become identical with a predetermined value.

* * * * *

UNITED STATES PATENT AND TRADEMARK OFFICE

CERTIFICATE OF CORRECTION

PATENT NO. : 4,208,139

DATED : June 17, 1980

INVENTOR(S) : Fujimoto et al

It is certified that error appears in the above-identified patent and that said Letters Patent are hereby corrected as shown below:

Under the heading "[73] Assignee" change "Sharp Kabushiki Kaisha, Osaka, Japan" to --Nippon Telegraph and Telephone Public Corporation, Tokyo, Japan and Sharp Kabushiki Kaisha, Osaka, Japan-- and

Under the heading "[75] Inventors" change "Isao Fujimoto, Kunitachi; Takeshi Kasubuchi; Yuji Sumitomo, both of Nara, all of Japan" to --Isao Fujimoto, Kunitachi; Takeshi Kasubuchi, Nara; Yuji Sumitomo, Nara; Yoichi Shimazawa, Yamatokoriyama; Masahiko Aiba, Nara, all of Japan--

Signed and Sealed this

*Seventh* Day of *April 1981*

[SEAL]

*Attest:*

RENE D. TEGTMEYER

*Attesting Officer*

*Acting Commissioner of Patents and Trademarks*